United States Patent [19]

Melvin et al.

[11] Patent Number: 4,925,193

[45] Date of Patent: May 15, 1990

[54] DIMPLED GOLF BALL

[75] Inventors: Terence Melvin, Somers, Conn.; R. Dennis Nesbitt, Westfield, Mass.

[73] Assignee: Spalding & Evenflo Companies, Inc., Tampa, Fla.

[21] Appl. No.: 335,348

[22] Filed: Apr. 10, 1989

Related U.S. Application Data

[63] Continuation of Ser. No. 159,429, Feb. 17, 1988, abandoned, which is a continuation of Ser. No. 818,627, Jan. 14, 1986, abandoned.

[51] Int. Cl.[5] ..... A63B 37/12

[52] U.S. Cl. ..... 273/232; 273/213

[58] Field of Search ..... 273/232, 235 R, 235 A, 273/235 B, 233, 234

[56] References Cited

U.S. PATENT DOCUMENTS

| | | | |
|---|---|---|---|
| 4,090,716 | 5/1978 | Martin et al. | 273/235 A |
| 4,141,559 | 2/1979 | Melvin et al. | 273/235 R |
| 4,560,168 | 12/1985 | Aoyama | 273/235 R |
| 4,653,758 | 3/1987 | Solheim | 273/232 |
| 4,729,861 | 3/1988 | Lynch et al. | 273/232 |

FOREIGN PATENT DOCUMENTS

| | | | |
|---|---|---|---|
| 1005480 | 2/1977 | Canada | 273/232 |
| 377354 | 7/1932 | United Kingdom | 273/232 |

*Primary Examiner*—George J. Marlo

*Attorney, Agent, or Firm*—Donald R. Bahr; John E. Benoit

[57] ABSTRACT

An aerodynamically symmetrical golf ball is provided including a patterned outer surface having 492 dimples arranged in twenty triangles based upon an inscribed modified icosahedron lattice on the surface of the ball. As a result of the modification of the lattice, a predetermined spacing exists between two in-line rows of dimples on opposite sides of an equatorial line about said ball, the spacing being created by the modification of th icosahedron on the surface of the ball.

7 Claims, 2 Drawing Sheets

DIMPLED GOLF BALL

This application is a continuation of Ser. No. 07/159,429 filed Feb. 17, 1988, now abandoned which is a continuation of Ser. No. 06/818,627 filed Jan. 14, 1986 now abandoned.

This invention relates generally to golf balls and more particularly to a specific arrangement of dimples on a golf ball.

It is generally known that for any given number of dimples on a golf ball it is desirable to put the largest diameter dimple on the ball. In British Patent Provisional Specification Serial Number 377,354 filed May 22, 1931 in the name of John Vernon Pugh, there is disclosed the fact that, by use of an icosahedral lattice for defining dimple patterns on a golf ball, it is possible to make a perfectly symmetrical ball while providing the maximum number of dimples on the ball surface. This icosahedron lattice is developed by the known division of a sphere or spherical surface into like areas determined by an inscribed regular polyhedron such as an icosahedron.

The vertices of the triangles lie on the surface of the sphere and the lattice is defined by the lines which interconnect the vertices. This patent specification specifically details the means of plotting the icosahedron on the surface of a golf ball and, accordingly, will not be dealt with in detail herein.

One of the problems which arises with the Pugh golf ball is that there is no equatorial line on the ball which does not pass through some of the dimples in the ball. Since golf balls are molded and manufactured by using two hemispherical half molds, the ball, as it comes from the mold, has a flash line about the equatorial line created by the two hemispheres of the mold. Such molding needs a clear flash line. If the dimples occur on the flash line, these dimples function as undercuts which prevent the ball from being removed from the mold. Further, even if the ball could be molded with dimples on the flash line, the ball could not be properly cleaned and finished, since the flash could not be cleaned from the bottom of the dimple.

The Pugh ball is geometrically symmetrical, and, therefore, is also aerodynamically symmetrical. Any changes in dimple location which affect the aerodynamic symmetry under USGA standards will render the ball illegal for sanctioned play.

Accordingly, it is an object of this invention to provide a modified icosahedron lattice for defining dimple locations on the surface of a golf ball, which modification results in an equatorial line which does not pass through any dimples on the golf ball.

A further object of this invention is to provide a golf ball having dimples within a modified icosahedral pattern on a surface of the golf ball wherein opposed in-line dimples are spaced on either side of an equatorial line created by the modification of the icosahedral pattern. This equatorial line provides a clean flash line for the mold.

Another object of this invention is to provide a golf ball having dimple locations defined by a modified icosahedron triangle which is aerodynamically symmetrical.

A still further object of the invention is to provide a golf ball having 492 dimples arranged in a pattern on the surface of the wall wherein the ball is aerodynamically symmetrical.

These and other objects of the invention will become obvious from the following description when taken together with the drawings.

SUMMARY OF THE INVENTION

The present invention provides an aerodynamically symmetrical golf ball including a patterned outer surface having a preselected number of dimples arranged in 20 triangles based upon an inscribed modified icosahedron lattice on the surface of the ball. A predetermined spacing is provided between between two rows of in-line dimples on opposite sides of a preselected equatorial line about the ball, the equatorial line being created by the modification of the icosahedron lattice on the surface of the ball through adjustment of the vertices of the triangles and associated great circle arcs.

DETAILED DESCRIPTION OF THE DRAWINGS

Figure 1:
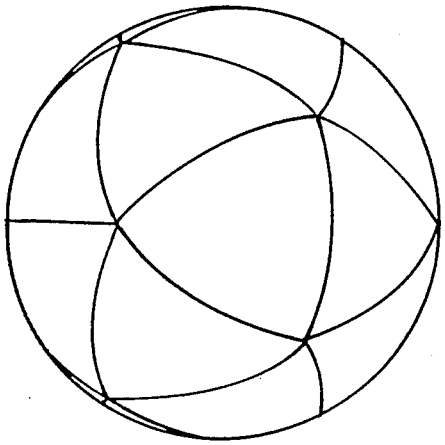
FIG. 1 (PRIOR ART)
FIG. 1 is a plan view of the icosahdral lattice of the prior art.

FIG. 1 illustrates the prior art icosahedral pattern on a ball as described in the Pugh patent specification discussed above. This lattice work provides triangles for the placement of the dimples on the surface of the golf ball as described by Pugh. The size of the dimples will determine the number which ultimately appear on the surface of the ball. However, as it quite apparent from the review of the Pugh disclosure, there is no equatorial line on the ball which does not pass through some of the dimples on the ball. As discussed above, this is unsatisfactory for the mass manufacture of the ball using two hemispherical molds, due to the resulting flash line which passes through the dimples.

As background for the following discussion, all officially sanctioned golf balls in use today have diameters between 1.62 inches and 1.70 inches. The specific parameters discussed are substantially correct for golf balls lying within such parameters with only minor variations.

Figure 2:
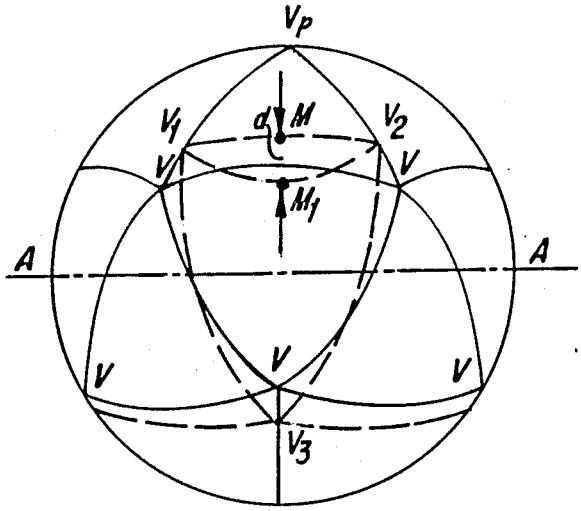
FIG. 2 is a plan view of a golf ball illustrating the lattice of FIG. 1 as modified by the present invention.

In order to provide the arrangement of the dimples in accordance with the present invention, the icosahedron lattice of FIG. 1 is modified to a position indicated by the dashed lines in FIG. 2. As illustrated, the location of all of the vertices V except the polar verticies $V_P$ are moved towards the nearest pole by a predetermined distance d. In the present case, such distance is substantially 0.007". This forms new vertices, $V_1$, $V_2$ and $V_3$ as indicated in FIG. 2. Constant radius arcs are drawn to connect these relocated verticies $V_1$ which results in a modified triangle as shown the dotted lines The center point M of line $V_1$ $V_2$ which is substantially parallel to the equator line A—A, is moved towards the equator by a predetermined distance in the present case substantially 0.015" so as to form a new center point M1. An arc having a constant radius is then drawn through the point M1 so as to interconnect the associated verticies $V_1$ $V_2$.

The movement of vertices $V_1$, $V_2$ and $V_3$ toward their respective poles adjusts the configuration of the triangles encompassing the equation so as to provide an additional spacing within the triangle on either side of the equator. In the configuration discussed above, the additional spacing is created by a line 0.007" on either side of the equator, prior to milling. This creates the distance f, FIG. 4, of 0.014 inches. The use of this additional spacing is discussed below. The movement of the midpoint M toward the equator to the point M1 adjusts the relative location of the dimples so as to attain the required aerodynamic symmetry.

Figure 4:
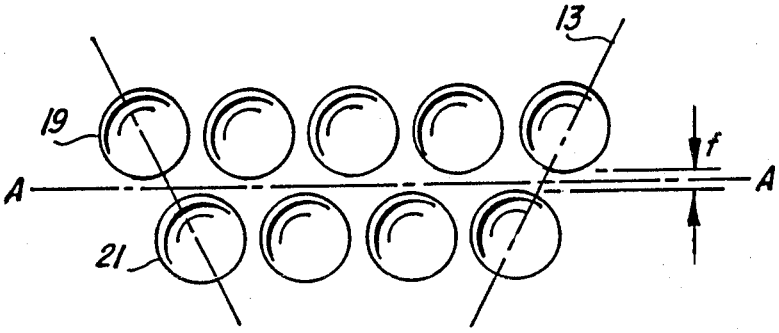
FIG. 4 is an enlarged view of a section of FIG. 3 illustrating the equatorial line on the golf ball and the associated opposed rows of in-line dimples on either side of the equator.
Figure 3:
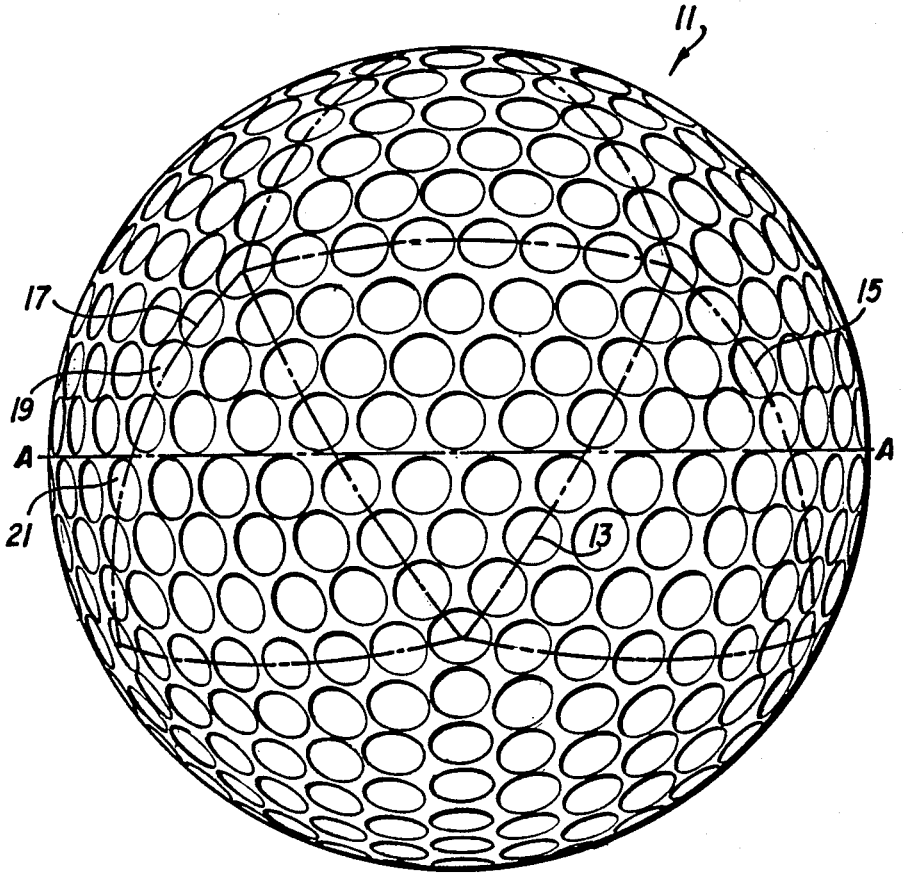
FIG. 3 is a plan view of a golf ball illustrating the location of the dimples on the surface of the ball.

The effect of the above modification of the icosahedron lattice is shown in FIGS. 3 and 4, FIG. 3 being a plan view of a ball having the modified icosahedron lattice of 20 triangles on the surface of the golf ball. In the illustration shown and described, the golf ball has 492 dimples thereon. With such configuration each of the triangles includes 15 whole dimples, 18 dimples shared 50% with adjacent triangles and 3 dimples shared with 5 other triangles.

As shown in FIG. 3, and more specifically in FIG. 4, the icosahedron, modified as described above, rearranges the dimples so as to create a selected distance f between two substantially parallel rows of dimples on either side of equatorial line A—A. In such a configuration, all triangles such as triangles 11, 13 and 15 contain the dimple arrangement in the numbers as discussed above.

The modification of the icosahedral lattice results in two rows of in-line dimples 19 and 21 which are separated by the small distance f so as to create the equatorial line A—A about the circumference of the ball which does not intersect any of the dimples on the ball. In the present illustration, this results in a separation of substantially 0.014 inches, prior to milling, between the two in-line rows such that the dimples on either side are spaced from the equatorial line A—A by substantially 0.007 inches which is the additional spacing created by the movement of the vertices $V_1$, $V_2$ and $V_3$, as discussed above.

With such a very small spacing between the two in-line rows of dimples resulting from the modification of the icosahedron lattice, the golf ball remains aerodynamically symmetrical in flight. At the same time, the ball can be molded with two hemispherical molds since the flash line resulting from the molding occurs at the equator and does not intersect any dimples and, therefore, may easily be cleaned so as to present a finished gold ball.

In the specific golf ball in question, consideration was given to the fact that an increase in the number of dimples affects the flight of the ball. Specifically, with the larger number of dimples, that is 492, a ball tends to drop at a steeper angle on its down flight so that it holds the green better than a standard ball having a flatter downward trajectory.

If the location of the dimples in an icosahedral pattern are altered to any great extent, the aerodynamics symmetry of the ball can be destroyed and, therefore, would not meet USGA requirements, and the ball would not react properly in flight after being hit. The present invention maintains aerodynamic symmetry and is in conformance with USGA requirements.

The above description and drawings are illustrative only since modifications could be made without departing from the basic concept of the use of a modified icosahedron as set forth in the invention. Accordingly, the invention is to be limited only by the scope of the following claims.

We claim:

1. An aerodynamically symmetrical golf ball having two poles and an equator and having a preselected number of dimples arranged in a twenty triangular configuration based upon a modified icosahedron lattice, said lattice comprising a plurality of adjacent triangles on either side of the equator with one vertice of each of said adjacent triangles being located at each pole of said ball;

all vertices other than the said polar vertices being displaced from their standard icosahedral location a predetermined distance towards the nearest pole, each of said vertices being interconnected by a constant radius arc on the surface of said ball;

the center point of each of said constant radius arcs which are substantially parallel to said equator being moved towards the equator a predetermined distance, said center points and adjacent vertices lying on a constant radius curve;

said preselected number of dimples being spaced within said modified lattice such that the dimples adjacent to and on opposite sides of said equator are substantially in-line and spaced a predetermined distance apart so as to provide a dimple-free equator.

2. The golf ball of claim 1 wherein each of said triangles includes fifteen whole dimples, eighteen dimples shared 50% with adjacent triangles and three dimples shared with five other triangles.

3. The golf ball of claim 1 wherein said ball is of a diameter between 1.62 and 1.70 inches and each dimple has a diameter of substantially 0.126 inches and a depth of substantially 0.0092 inches.

4. The golf ball of claim 1 wherein said dimples are circular.

5. The golf ball of claim 1 wherein said preselected number of dimples is 492.

6. The golf ball of claim 1 wherein the predetermined distance of movement of said vertices is substantially 0.007 inches.

7. The golf ball of claim 1 wherein the predetermined distance of movement of said center points of said great circles is substantially 0.015 inches.

* * * * *